United States Patent [19]

Powell et al.

[11] Patent Number: 4,991,514

[45] Date of Patent: Feb. 12, 1991

[54] ELECTROMAGNETICALLY POWERED DRAG RIDE ATTRACTION

[76] Inventors: Tyrone E. Powell, 2000 Otter St., Anchorage, Ak. 99504; James Trani, 10842 Langmuir, Sunland, Calif. 91040

[21] Appl. No.: 456,479

[22] Filed: Dec. 26, 1989

[51] Int. Cl.[5] ..... A63G 25/00

[52] U.S. Cl. ..... 104/60; 104/35; 104/67; 104/292

[58] Field of Search ..... 104/35, 44, 45, 60, 104/67, 282, 290, 292; 273/86 B

[56] References Cited

U.S. PATENT DOCUMENTS

| | | | |
|---|---|---|---|
| 1,064,681 | 6/1913 | Cawthon et al. | 104/60 |
| 1,749,324 | 3/1930 | Craig | 104/44 |
| 3,403,908 | 10/1968 | Sheldon et al. | 273/86 B |
| 3,565,430 | 2/1971 | McRoskey | 273/86 B |
| 3,566,798 | 3/1971 | Peitzman | 104/44 |
| 3,606,328 | 9/1971 | Delphia | 104/60 |
| 3,841,227 | 10/1974 | Fink | 104/290 |
| 4,872,680 | 10/1989 | Dennis | 273/86 B |

*Primary Examiner*—George E. A. Halvosa
*Assistant Examiner*—S. Joseph Morano
*Attorney, Agent, or Firm*—Michael I. Kroll

[57] ABSTRACT

An electromagnetically powered drag racing ride attraction is disclosed. The present invention includes a two lane track having a starting line and designed to look and operate like a conventional drag strip, each lane of the two lane track having a track bed, a center line, a data link, a far end, and a near end of the track, a load/unload vehicle rotation assembly disposed at the far end of the two lane track, the far end of the turntable/transfer table assembly turning the vehicles around and facilitating loading and unloading of the vehicles off the two lane track simultaneously while two other vehicles are racing down the two lane track, a vehicle support pedestal disposed at the center line of the each of the two lane tracks, a continuous row of loudspeakers mounted within the pedestal, a linear induction motor support rail, a linear induction motor affixed to the linear induction motor support rail in the two lane track bed, induction plate assemblies disposed on the vehicles, and a turntable assembly disposed at the near end of the two lane track, the turntable turning the vehicles around for their return run down the two lane track.

15 Claims, 3 Drawing Sheets

ELECTROMAGNETICALLY POWERED DRAG RIDE ATTRACTION

BACKGROUND OF THE INVENTION

1. Field of the Invention

The present invention relates to a ride attraction.

More particularly, the present invention relates to an electromagnetically powered drag racing ride attraction.

2. Description of the Prior Art

JCA Engineers and Innovative Ride Concepts is a concern concentrating on the development of new and innovative ride attractions. The present invention provides an opportunity for the general public to experience the physical sensations of drag racing. The present invention is an electromagnetically powered drag racing ride attraction that simulates the experience of drag racing utilizing conventional vehicle technology. While it can match the acceleration and speed of a world-class funny car, it is completely safe and operable by a novice. Due to its innovative technology, the present invention is mobile and can be operated in conjunction with a racing tour, county fairs, or any other form of preexisting large capacity audience.

The capital cost of this attraction is in the midrange of conventional ride costs. It is estimated that this attraction has a payback period of less than one year. In addition to having exceptional investment potential, the Present invention is also a potentially large scale public relations mechanism for an organization seeking exposure through recreational and/or entertainment activities.

Numerous innovations for electromagnetically powered ride attractions have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide electromagnetically powered ride attraction that avoids the disadvantages of the prior art.

More particularly, it is an object of the present invention to provide an electromagnetically powered ride attraction that uses linear electrical motors (L.I.M.). Indeed any rotary motor can be made into a linear motor by redesigning the stator and rotor, in a flat form.

Because of their simplicity, ruggedness, and lack of expensive gears and transmissions, linear motors are finding ever widening applications.

In general, the thrust of a low speed linear induction motor varies with velocity and applied voltage. The thrust is proportional to the square of the applied voltage and drops to zero at synchronous velocity.

Normal or attractive forces between the primary and the secondary depends on whether the secondary is constructed as an aluminum steel laminate or as a simple steel plate. For an aluminum-steel secondary, the normal force is approximately 10% of the thrust. For a steel secondary, the normal force is 10 times the thrust.

For optimum performance, the air gap should be as small as possible, and be consistent with the mechanical clearance requirements.

Power requirements are approximately 50 voltamperes per pound of rated thrust. Power varies linearly with thrust, up to the magnetic saturation level of the primary.

Duty Cycle is defined as the ratio of time on to the total cycle time and is limited by the heat dissipation ability of the motor.

Simple programed control of a linear induction motor is achieved by the use of on/off switches located at various points in its duty cycle. These switches can be of the non-contacting or contacting type, depending on the application.

Since the thrust of a L.I.M. is proportional to the square of the applied voltage, it is possible to switch to lower voltages during portions of the cycle to achieve a more sophisticated programed control. Other options, such as auxiliary holding coils at the end of the stroke or hydraulic dampers are used in some applications.

Under no-load conditions, a linear motor travels at synchronous speed. Under load, the motor moves at a speed that coincides with the intersection of the thrust and load. Linear motors are speed controlled by the same means used for rotary induction motors, that is, frequency changing or pole pitch changing. The first method, for most applications, is inconvenient and/or too expensive. The second method requires elaborate switching to change the interconnection of the coils, or an additional set of windings interconnected to produce a different synchronous speed.

In most applications, the recommended method of speed control is a servo type control, using a velocity feed back signal to modulate the input voltage to the motor.

In keeping with these objects, and With others which will become apparent hereinafter, one feature of the present invention resides, briefly stated, in an electromagnetically powered drag racing ride attraction, comprising, a two lane track having a starting line and designed to look and operate like a conventional drag strip, each lane of the two lane track having a track bed, a center line, a data link, a far end, and a near end of the track, a load/unload vehicle rotation assembly disposed at the far end of the two lane track, the far end of the turntable/transfer table assembly turning the vehicles around and facilitating loading and unloading of the vehicles off the two lane track simultaneously while other vehicles are racing down the two lane track, a vehicle support pedestal disposed at the center line of each of the two lane tracks, a continuous row of loudspeakers mounted within the pedestal, a linear induction motor support rail, a linear induction motor affixed to the linear induction motor support rail in the two lane track bed, induction plate assemblies disposed on the vehicles, and a turntable assembly disposed at the near end of the tWo lane track, wherein the turntable turns the vehicles around for their return run down the two lane track.

When the electromagnetically powered drag racing ride attraction is designed in accordance with the present invention, drag racing simulation becomes safe.

In accordance with another feature of the present invention, the vehicle comprises a body which pivots open and closed from the rear for loading and unloading, and a chassis on to which the body pivots.

Another feature of the present invention is that the chassis has a top side on to which four passenger seats are mounted, an accelerator, and instrumentation.

Yet another feature of the present invention is that the chassis has a bottom on to which four trucks are mounted and the two induction plate assemblies.

Still another feature of the present invention is that the trucks comprise a top load bearing wheel, a bottom upward lift restraining wheel, and a side lateral stabilizing wheel.

Yet still another feature of the present invention is that the support equipment comprises a conversion plant, a poWer generation plant, a motor speed control center, and a computer control center.

Still yet another feature of the present invention is that the power conversion plant generates power at the various operating frequencies of the linear induction motor, the power conversion plant receiving power from an on-site power generator.

Another feature of the present invention is that the power conversion plant supplies power to the motor speed control center which controls the amount of thrust exerted on the vehicle by the linear induction motor.

Yet another feature of the present invention is that the speed control center is controlled by computers located in the computer control center, the computers receive the accelerator signal from the vehicle and converts it to an equivalent vehicle acceleration via the linear induction motor and controlling the simulated sound via the loud speakers, and the computer adjusting the acceleration of the vehicle for various track conditions.

Still another feature of the present invention is that the track is 400 feet long or longer depending upon the track, which have been known to be one half mile long.

Yet still another feature of the present invention is that the track is 17 feet wide.

Still yet another feature of the present invention is that the two lane track, the load/unload vehicle rotation assembly, the vehicle support pedestal, the linear induction motor support rail, the induction plate assembly, and the turntable assembly are all made of steel or aluminum.

Another feature of the present invention is that the track is in 40 feet sections for portability.

Yet another feature of the present invention is that the transfer table moves the vehicles to the mainline track.

Still another feature of the present invention is that it further comprises a full Christmas tree disposed at the starting line.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figure 2:
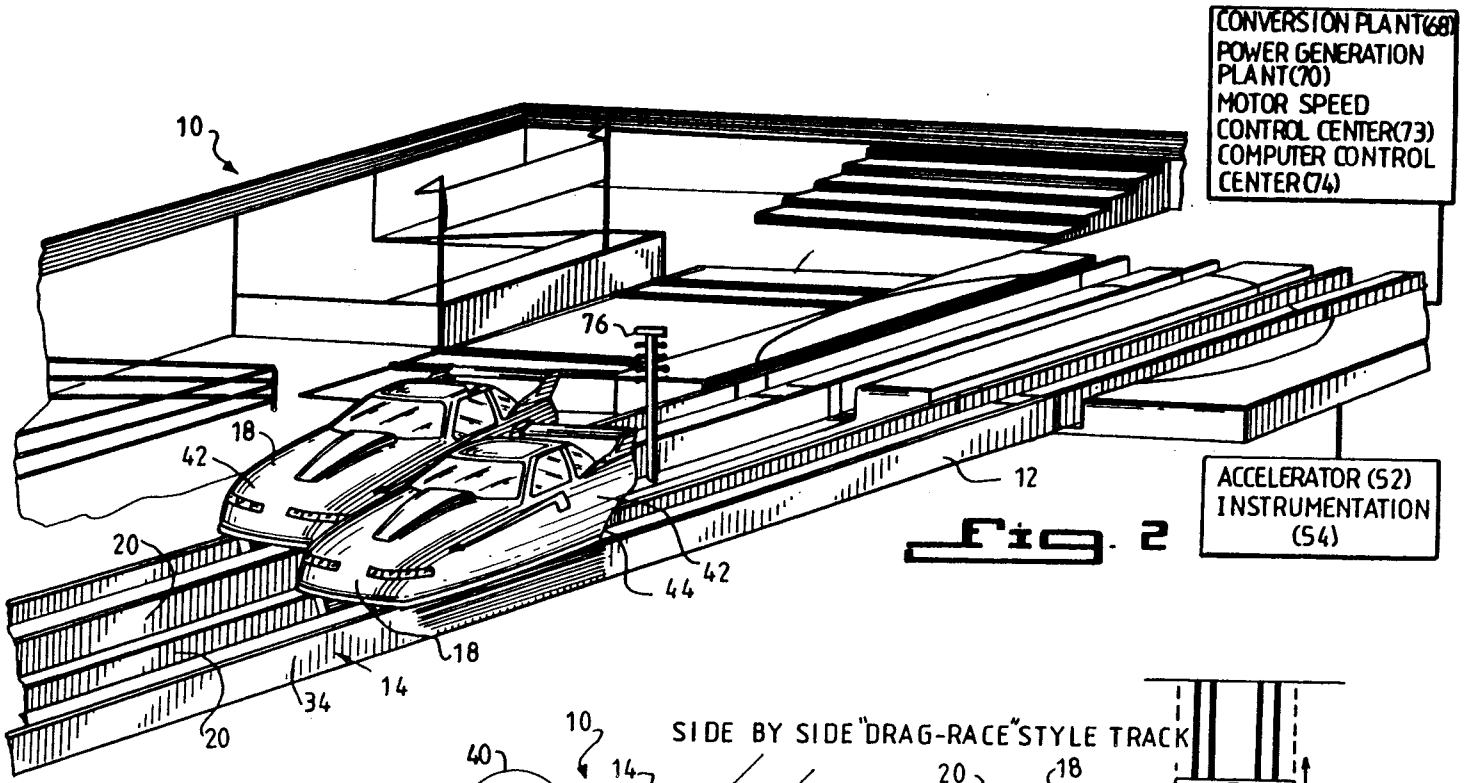
FIG. 2 is a perspective vieW of the electromagnetically powered drag racing ride attraction of the present invention, shown in FIG. 1.
Figure 1:
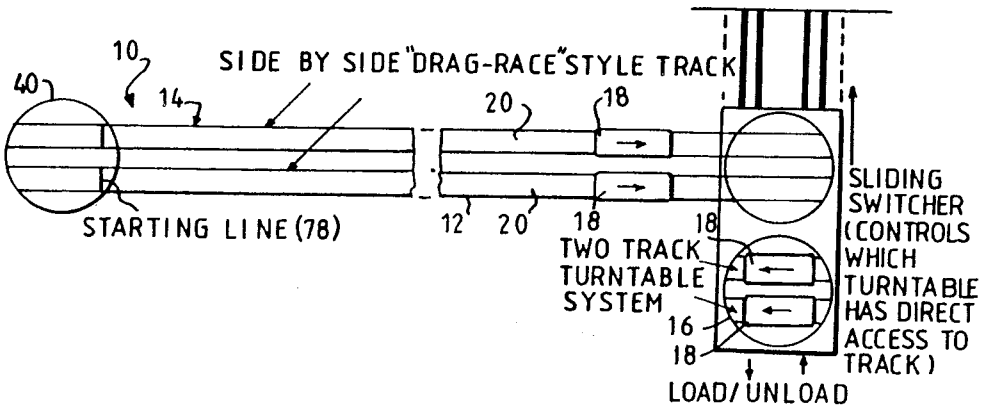
FIG. 1 is a substantially top schematic view of the electromagnetically poWered drag racing ride attraction of the present invention.
Figure 5:
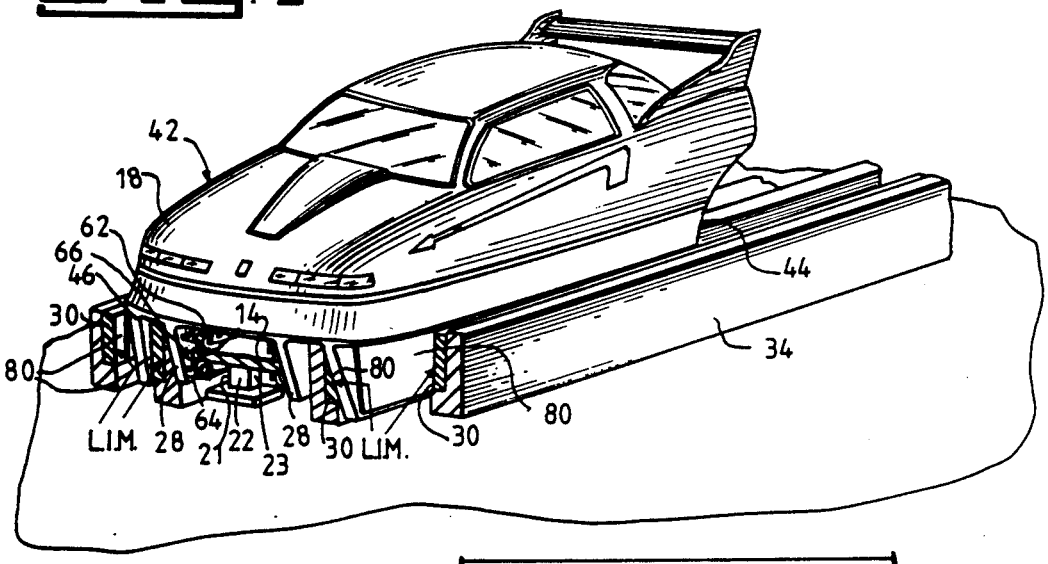
FIG. 5 is a perspective view of the vehicle used in the electromagnetically powered drag racing ride attraction of the present invention and showing a part of the improved front suspension combined with the truck system.
Figure 4:
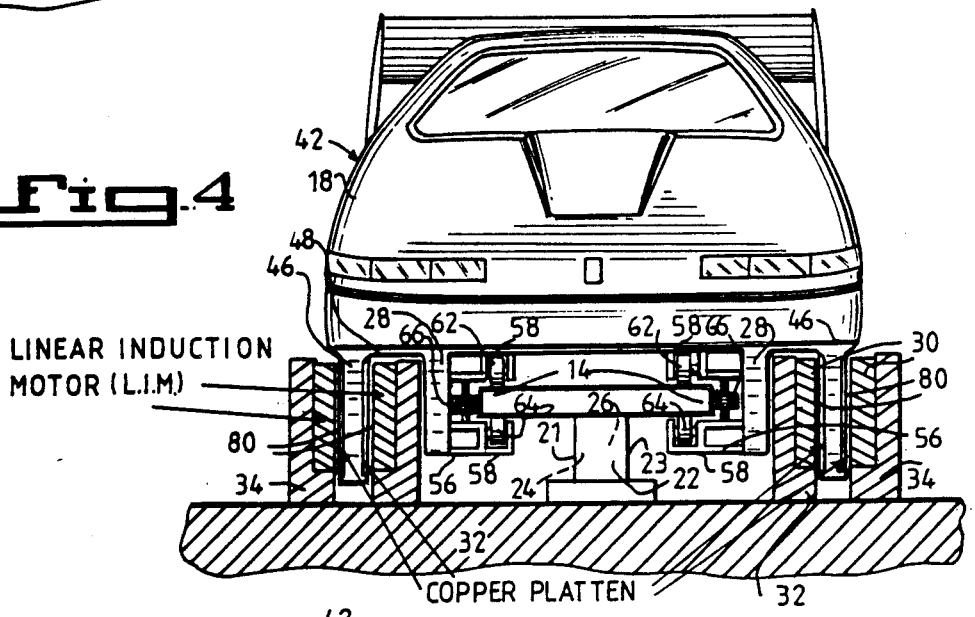
FIG. 4 is a front view of the vehicle used in the electromagnetically poWered drag racing ride attraction of the present invention and showing the improved truck system.
Figure 3:
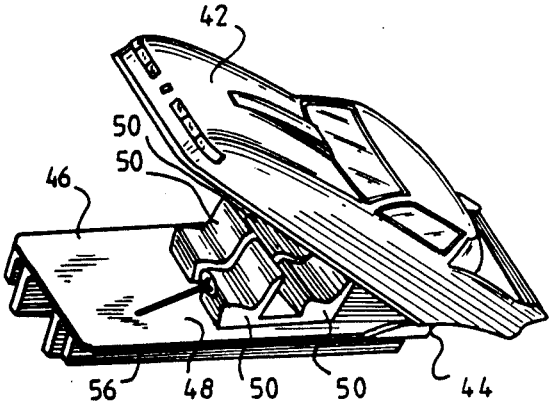
FIG. 3 is a perspective view of the vehicle utilized in the electromagnetically powered drag racing ride attraction of the present invention and having the body hinged open from the chassis for easier servicing, as is done with sanctioned drag racing vehicles.
Figure 6:
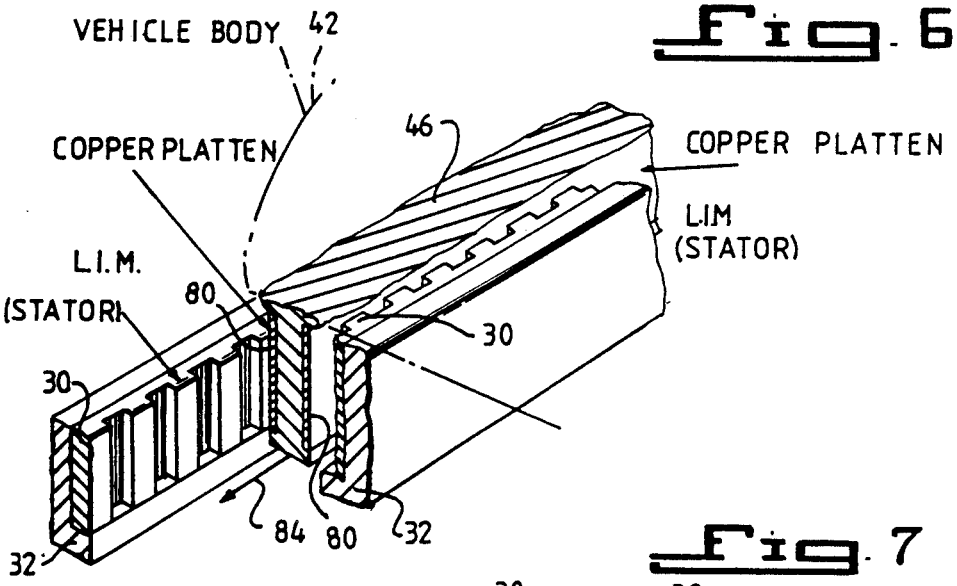
FIG. 6 is a perspective view of part of the improved front suspension system used in the electromagnetically poWered drag racing ride attraction of the present invention.
Figure 7:
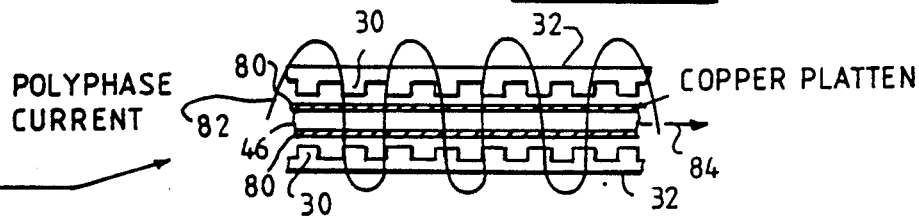
FIG. 7 is a top view of part of the improved front suspension system used in the electromagnetically powered drag racing ride attraction of the present invention and showing a polyphase current passing through a part of the improved suspension system.
Figure 8:
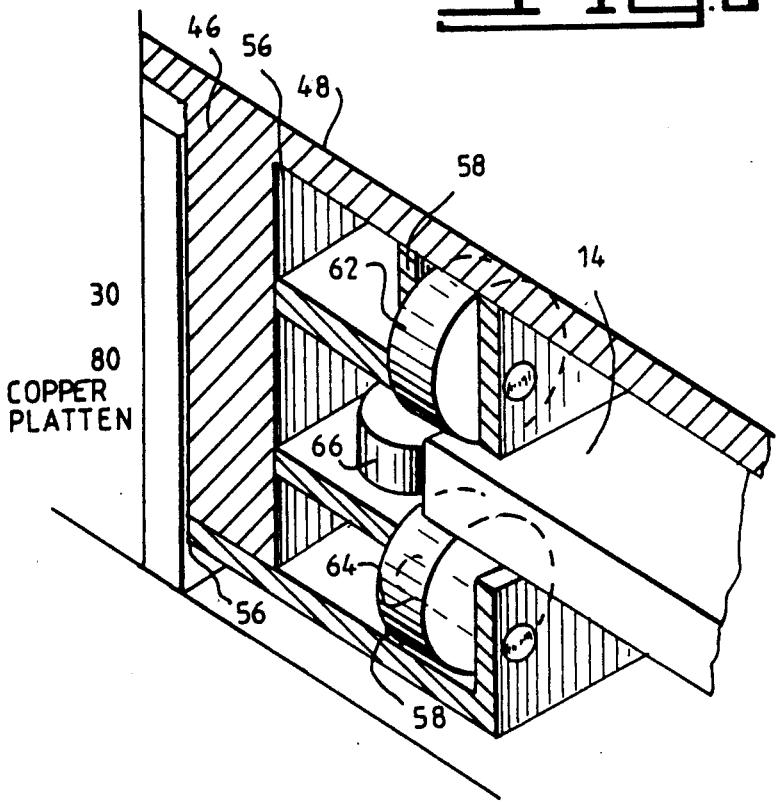
FIG. 8 is a perspective view of the undercarriage of the vehicle used in the electromagnetically powered drag racing ride attraction of the present invention and showing the interface between the undercarriage and the track.

10 - electromagnetically powered drag racing ride attraction of the present invention
12 - conventional drag strip
14 - two lane track
16 - load/unload vehicle rotation assembly
18 - vehicles
19 - support equipment
20 - center line of each track
21 - side of pedestal 22
22 - vehicle support pedestal
23 - other side of pedestal 22
24 - continuous row of loudspeakers
26 - data link
28 - linear induction motor support rail
30 - linear induction motor
32 - track bed
34 - track alignment
36 - induction plate assembly
38 - turntable assembly
40 - dual turntable/transfer table assembly
42 - vehicle body
44 - vehicle rear
46 - vehicle chassis
48 - top side of the vehicle chassis 46
50 - four passenger seals
52 - accelerator
54 - instrumentation
56 - bottom side of the vehicle chassis 46
58 - four trucks
60 - pair of induction plate assemblies
62 - top load bearing wheel
64 - bottom upward lift restraining wheel
66 - side lateral stabilizing wheel
68 - conversion plant
70 - power generation plant
72 - motor speed control center
74 - computer control center
76 - Christmas tree
78 - starting line

DETAILED DESCRIPTION OF THE PREFERRED EMBODIMENT

The present invention 10 is designed to look and operate like a conventional drag strip 12. It consists of at least 400 feet of two lane track 14, a load/unload vehicle rotation assembly 16, Vehicles 18, and support equipment 19.

The two lane track 14 is 17 feet Wide. At the center line 20 of each track 14 is a vehicle support pedestal 22. Mounted Within this pedestal 22 are a continuous row of loudspeakers 24 and a data link 26 to the vehicle 18. Adjacent to both sides 21, 23 of the pedestal 22 is the linear induction motor support rail 28. The entire track assembly is constructed of structural steel and/or aluminum. The vehicle 18 is propelled by a technology referred to as linear induction motor 30 technology.

The linear induction motor 30 is mounted on the track bed 32 along the track alignment 34. The linear induction motor 30 is 12" wide and 15" long and is mounted on 30" centers. These linear induction motors 30 operate With no moving parts. The linear induction motor 30 in the two lane track 14 induces a magnetic field into an induction plate assembly 36 located on both sides of the vehicle 18. In return, the induction plate assembly 36, as a result of the initial magnetic field, produces a counter magnetic field against the linear induction motor 30, in the two lane track 14. The net result of these magnetic fields is a 3,120 pound thrust exerted on the vehicle 18. The linear induction motor 30 can move the vehicle 18 forward, backward, up and down. The two lane track 14 is constructed in 40 foot sections for portability.

A turntable assembly 38 is located at the far end of the tWo lane track 14 and a dual turntable/transfer table assembly 40 is located at the near end. The far end turntable assembly 38 simply turns the vehicles 18 around at the end of the first run for their return run down the two lane track 14. The near end dual turntable/transfer table assembly 40 turns the vehicles 18 around and facilitates loading and unloading of the vehicles off the mainline, simultaneous to two vehicles 18 racing down the mainline.

The vehicle 18 is dimensional identical to a standard funny or a pro-stock car. It consists of a vehicle body 42, which pivots open and closed from the vehicle rear 44 for loading and unloading, and a vehicle chassis 46. On the top side 48 of the vehicle chassis 46 is mounted four passenger seats 50, an accelerator 52 and instrumentation 54. On the bottom side 56 of the vehicle chassis 46 is mounted four trucks 58 and a pair of induction plate assemblies 60. The four trucks 58 consist of a top load bearing wheel 62, a bottom upward lift restraining Wheel 64, and a side lateral stabilizing wheel 66.

The support equipment includes a conversion plant 68, a power generation plant 70, a motor speed control center 72, and a computer control center 74. The power conversion plant 68 generates power at the various operating frequencies of the linear induction motor 30. The power conversion plant 68 receives its power from an on-site power generator, fed by fossil fuel or natural gas. The generator size is approximately 30 kW. The conversion plant 68 supplies power to the motor speed control center 74 Which controls the amount of thrust exerted on the vehicle 18 by the linear induction motor 30. The motor speed control center 72 is controlled by computers located in the computer control center 74.

The computers receive the accelerator signal from the vehicle 18 and convert it to an equivalent vehicle acceleration via the linear induction motor 30, and controls the simulated sound via the loud speakers 24. In addition, the computer adjusts the acceleration of the vehicles 18 for various track conditions or simulated vehicle failures.

In operation, four passengers enter each of the two vehicles 18, while the vehicles 18 are sitting on the turntable assembly 38 at the extreme end of the dual turntable/transfer table assembly 40. With the passengers in place and the Vehicle 18 body lowered, the dual turntable/transfer table assembly 40 moves the vehicles 18 to the mainline tWo lane track 14. The computers simulate a vehicle 18 burn-in by quickly accelerating and torquing the vehicle 18. The speakers 24 in the turntable assembly 38 produce the sounds of a burn-in. The computer backs the vehicle 18 up and burn-in's again. The vehicle 18 is then moved to the starting line 78. This burn-in sequence lasts for 6 seconds.

A full Christmas tree 76 is located at the starting line 78. The computer gives acceleration control to the driver. The Christmas tree 76 goes through its sequence, and the race begins. At this point, the driver's reflexes are tested. The vehicle 18 may slip or the front could lift, depending upon the applied acceleration of the driver.

The two vehicles 18 now race down the two lane track 14. The vehicle 18 has the capability of accelerating at 41 ft/sec$^2$ (1.3 g's) fully loaded. At 260 feet down the two lane track 14, the vehicle 18 reaches its top speed of 90 miles per hour in 3.5 seconds. The stop, 6.0 seconds after the start of the race. Throughout the race the sound system 24 in the two lane track 14 follows the vehicle 18 with sounds emulating a real race.

The vehicle 18 rolls onto the turntable 38 assembly and is rotated 180° for a repeat run down the two lane track 14. The vehicle !8 reaches the dual turntable/-transfer table assembly 40, fifteen seconds after the start of the race. The dual turntable/transfer table assembly 40 rotates the vehicles 40 into the load/unload area 16 and the guests leave the vehicles 18. The total ride experience time for the guest is about 20 seconds. Simultaneous to the race of the two vehicles 18, two other vehicles !8 are in the process of loading and unloading in the second turntable assembly 38. With this sequence, 1,440 guests per hour can experience this attraction.

It will be understood that each of the elements described above, or two or more together, may also find a useful application in other types of constructions differing from the type described above.

While the invention has been illustrated and described as embodied in an electromagnetically powered drag racing ride attraction, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An electromagnetically powered drag racing ride attraction, comprising:

(a) a two lane track having a starting line and designed to look and operate like a conventional drag strip, each lane of said two lane track having a track bed, a center line, a data link, a far end, and a near end of said track;

(b) a plurality of vehicles, and a load/unload vehicle rotation assembly disposed at said far end of said two lane track, said load/unload vehicle rotation assembly turning said vehicles around and facilitating loading and unloading of said vehicles off said two lane track simultaneously while two other vehicles are racing down said tow lane track;

(c) a vehicle support pedestal disposed at said center line of said each of said two lane tracks;

(d) a continuous row of loudspeakers mounted within said pedestal;

(e) a linear induction motor support rail;

(f) a linear induction motor affixed to said linear induction motor support rail in said two lane track bed;

(g) induction plate assemblies disposed on said vehicles; and (h) a turntable assembly disposed at said near end of said two lane track, said turntable assembly turning said vehicles around for their return run down said two lane track.

2. A ride attraction as defined in claim 1, wherein said vehicles each comprise a body which pivots open and closed from the rear for loading and unloading, and a chassis from which said body pivots.

3. A ride attraction as defined in claim 2, wherein said chassis has a top side on to which four passenger seats, an accelerator, and instrumentation are mounted.

4. A ride attraction as defined in claim 3, wherein said chassis has a bottom side on to which four trucks and said induction plate assemblies are mounted.

5. A ride attraction as defined in claim 4, wherein said trucks comprise a top load bearing wheel, a bottom upward lift restraining wheel, and a side lateral stabilizing wheel.

6. A ride attraction as defined in claim 5, further comprising support equipment, wherein said support equipment comprises a power conversion plant, a poWer generation plant, a motor speed control center, and a computer control center.

7. A ride attraction as defined in claim 6, wherein said power conversion plant generates power at the various operating frequencies of said linear induction motor, said power conversion plant receiving power from an on-site power generator.

8. A ride attraction as defined in claim 7, wherein said power conversion plant supplies power to said motor speed control center which controls the amount of thrust exerted on said vehicle by said linear induction motor.

9. A ride attraction as defined in claim 8, Wherein said motor speed control center is controlled by computers located in said computer control center, said computers receiving an accelerator signal from said vehicles and converting it to an equivalent vehicle acceleration via said linear induction motor and controlling simulated sound via said loud speakers, and said computer adjusting the acceleration of said vehicles for various track conditions.

10. A ride attraction as defined in claim 9, wherein said track is at least 400 feet long.

11. A ride attraction as defined in claim 10, wherein said track is 17 feet wide.

12. A ride attraction as defined in claim 11, Wherein said track, said load/unload vehicle rotation assembly, said vehicle support pedestal, said linear induction motor support rail, said induction plate assemblies, and said turntable assembly are all made of a material chosen from the group including steel and aluminum.

13. A ride attraction as defined in claim 12, wherein said track is in 40 feet sections for portability.

14. A ride attraction as defined in claim 13, wherein said load/unload vehicle rotation assembly moves said vehicles to said mainline track.

15. A ride attraction as defined in claim 14; further comprising a full Christmas tree disposed at a starting line.

* * * * *